US006321556B1

(12) United States Patent
Tesche et al.

(10) Patent No.: US 6,321,556 B1
(45) Date of Patent: Nov. 27, 2001

(54) THREE-WAY MOUNTING OF AN AIR CONDITIONER

(75) Inventors: Carlos Afonso Tesche, Canoas-RS; Juan Carlos Carne Correa, Porto Alegre-RS, both of (BR)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 09/485,755

(22) PCT Filed: Jun. 22, 1998

(86) PCT No.: PCT/BR98/00033

§ 371 Date: Feb. 15, 2000

§ 102(e) Date: Feb. 15, 2000

(87) PCT Pub. No.: WO99/67575

PCT Pub. Date: Dec. 29, 1999

(51) Int. Cl.[7] ..... F25D 21/14
(52) U.S. Cl. ..... 62/285; 62/298
(58) Field of Search ..... 62/285, 286, 298, 62/262

(56) References Cited

U.S. PATENT DOCUMENTS

| | | | | |
|---|---|---|---|---|
| 3,596,475 | | 8/1971 | Berger | 62/285 |
| 3,923,098 | * | 12/1975 | Ares | 165/111 |
| 4,385,505 | * | 5/1983 | Umezu et al. | 62/285 |
| 4,416,327 | * | 11/1983 | Nakada et al. | 62/262 |
| 5,044,260 | | 9/1991 | Avari | 98/40.28 |

FOREIGN PATENT DOCUMENTS

| | | | | |
|---|---|---|---|---|
| 442028 | | 8/1991 | (EP) . | |
| 2679986 | | 5/1993 | (FR) . | |
| 54-71843 A | * | 6/1979 | (JP) | 62/285 |
| 60-213747 A | * | 10/1985 | (JP) | 62/285 |
| 62-13937 A | * | 1/1987 | (JP) | 62/285 |

* cited by examiner

*Primary Examiner*—Henry Bennett
*Assistant Examiner*—Melvin Jones

(57) ABSTRACT

An evaporator unit for an air conditioning system includes a housing having a back panel and a front section. The front section defines an air inlet at one end and an air outlet at an opposite end thereof. The housing defines an air flow path through the unit extending from the inlet to the outlet. An evaporator coil is supported in the housing in the air flow path. The unit includes an evaporator fan for effecting air flow along the air flow path and through the evaporator coil where the air is cooled and water is removed therefrom resulting in condensation. The unit includes a first condensate collection pan mounted in the housing adjacent to the evaporator coil. The first condensate collection pan is configured to collect condensate from the evaporator coil when the evaporator unit is mounted with the back panel in a substantially vertical orientation with one end defining the lower end of the housing and the opposite end defining the upper end of the housing. The first condensate collection pan is further configured to collect condensate from the evaporator coil when the evaporator unit is mounted with the back panel facing upwardly in a substantially horizontal orientation. The unit includes a second condensate collection pan within the housing, which is configured to collect condensate from the evaporator coil when the unit is mounted with the back panel in a substantially vertical orientation with the air inlet at the upper end of the housing and the air outlet at the lower end of the housing.

9 Claims, 4 Drawing Sheets

THREE-WAY MOUNTING OF AN AIR CONDITIONER

TECHNICAL FIELD

The invention generally relates to air distribution units of the type commonly used in air conditioning, heating or ventilation systems and, more particularly, to such a unit which may be mounted in several different orientations.

BACKGROUND ART

In many commercial air conditioning, heating and ventilating systems, treated air is discharged into an area to be conditioned through an air distribution or conditioning unit. For example, one general type of air conditioning system, often referred to as a split system, includes separate indoor and outdoor units. The outdoor unit includes a compressor, a heat exchanger and a fan. The indoor unit includes a heat exchanger and a fan. In operation, the indoor fan draws air into the indoor unit, through an inlet thereof, and forces the air over the indoor heat exchanger and then out of the indoor unit, through an outlet opening therein.

The outdoor fan draws air into the outdoor unit, through an inlet, forces that air over the outdoor heat exchanger and then forces that air out of the outdoor unit through an outlet therein. At the same time, a compressor causes a refrigeration fluid to circulate through and between the indoor/outdoor heat exchangers. At the indoor heat exchanger, the refrigerant absorbs heat from the air passing over that heat exchanger, cooling that air. At the same time, at the outdoor heat exchanger, the air passing over the heat exchanger absorbs heat from the refrigerant passing therethrough. Typically a louvered assembly is disposed in the outlet of the indoor unit to direct the air discharge from that unit at a preferred angle.

Commonly, the indoor unit of a split system is mounted on the floor of a room against a wall thereof. In some situations, however, it is desirable to place the indoor unit in other locations, such as on the ceiling of the room or on the wall at a position above the floor. When mounting the indoor unit on the wall above the floor, a mounting which is commonly referred to as a "hi-wall split mount", it is desirable for the air discharge to be located at the bottom of the unit. Accordingly, a unit would be oriented exactly opposite from the mounting of a console mount unit.

A further benefit to the conditioning of the indoor air which occurs with such an air conditioning unit is the removal of undesired humidity in the air as the air being cooled is passed by the indoor heat exchanger. This dehumidification results in an accumulation of water as humidity condenses on the cold indoor heat exchanger coils. It is accordingly necessary to collect the removed water and divert it to an appropriate disposal point.

It should be appreciated that an indoor unit of an air conditioner, which may be mounted in each of the above-mentioned floor mount, ceiling mount, and hi-wall mount, with a bottom discharge orientation, while still providing the ability to collect the condensate from the unit would be extremely desirable.

An indoor unit for an air conditioning system which may be mounted as a floor, ceiling and wall mount is shown and described in U.S. Pat. No. 5,044,260. The air distribution unit, however, of the '260 patent provides a wall mount orientation with the air discharge at the top of the unit, which compromises the ability to place the unit in the high wall location, which is desirable of such units. Because the '260 unit must be mounted in the hi-wall application in the same orientation as the floor mount, in order to collect condensate, the unit must be mounted substantially below the ceiling line in order to achieve acceptable air discharge flow from the top of the unit.

DISCLOSURE OF THE INVENTION

An evaporator unit for an air conditioning system includes a housing having a back panel and a front section. The front section defines an air inlet at one end and an air outlet at an opposite end thereof. The housing defines an air flow path through the unit extending from the inlet to the outlet. An evaporator coil is supported in the housing in the air flow path. The unit includes an evaporator fan for effecting air flow along the air flow path and through the evaporator coil where the air is cooled and water is removed therefrom resulting in condensation. The unit includes a first condensate collection pan mounted in the housing adjacent to the evaporator coil. The first condensate collection pan is configured to collect condensate from the evaporator coil when the evaporator unit is mounted with the back panel in a substantially vertical orientation with one end defining the lower end of the housing and the opposite end defining the upper end of the housing. The first condensate collection pan is further configured to collect condensate from the evaporator coil when the evaporator unit is mounted with the back panel facing upwardly in a substantially horizontal orientation. The unit includes a second condensate collection pan within the housing, which is configured to collect condensate from the evaporator coil when the unit is mounted with the back panel in a substantially vertical orientation with the air inlet at the upper end of the housing and the air outlet at the lower end of the housing.

BRIEF DESCRIPTION OF THE DRAWINGS

The invention may be better understood and its objects and advantages will become apparent to those skilled in the art by reference to the accompanying drawings, in which.

BEST MODE FOR CARRYING OUT THE INVENTION AND INDUSTRIAL APPLICABILITY

Figure 1:
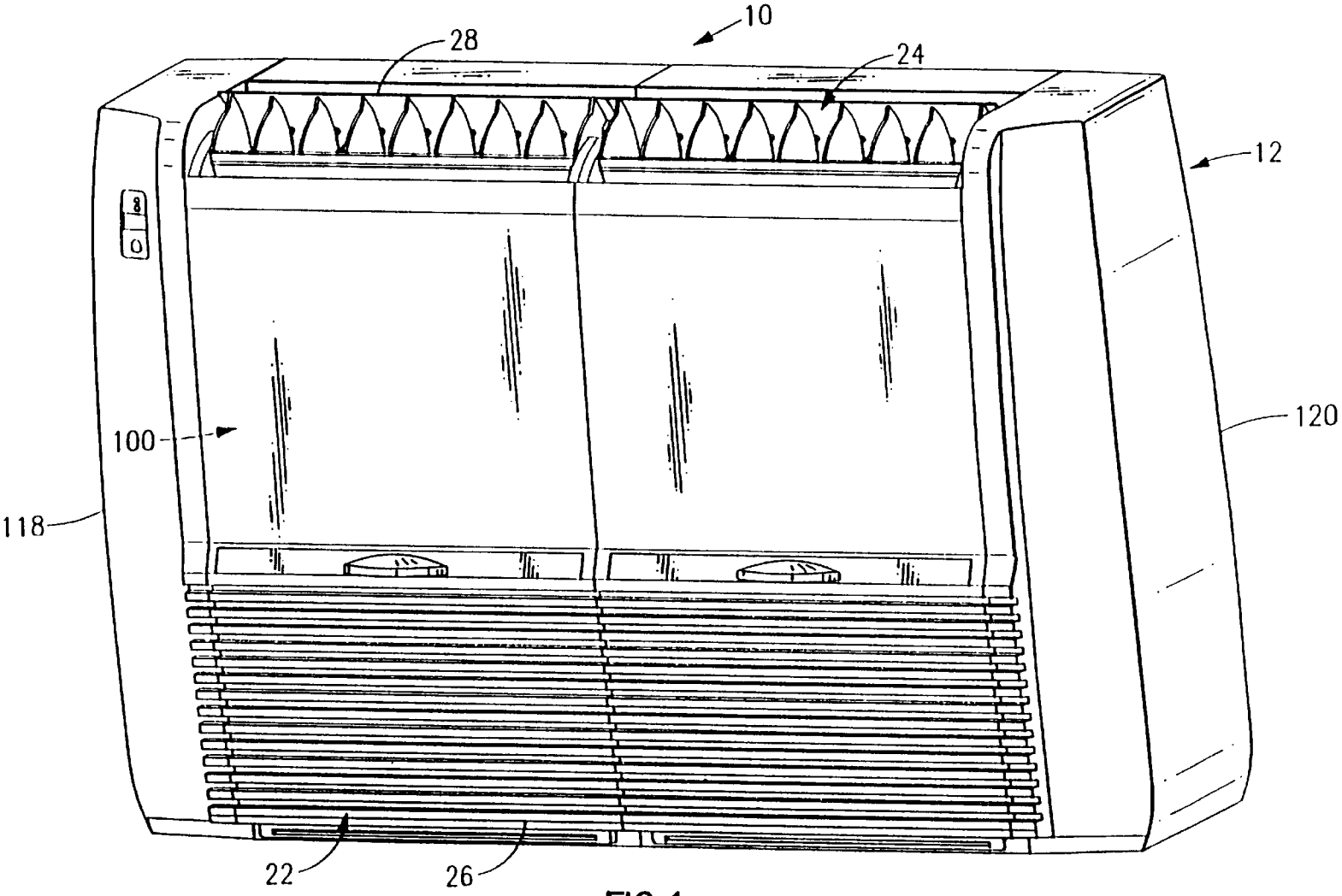
FIG. 1 is a perspective view of the indoor unit of an air conditioner which embodies the features of the present invention.

The drawing figures illustrate an indoor unit 10 of a split system air conditioner. As will be seen as the description continues, the unit includes an outer housing 12, evaporator fans 14, evaporator heat exchanger 16, and upper and lower condensate collection pans 18 and 20, respectively. Generally, the housing 12 defines an interior space for mounting the other components and defines an air flow path through the unit from an inlet 22 for conducting air into the interior and an outlet 24 for discharging air from the interior of the housing into the space to be conditioned. The fans 14, heat exchanger 16 and upper and lower condensate pans 18 and 20 are secured within the housing 12. An inlet grill 26 forms part of the housing and is located over the air inlet 22 and a discharge louver assembly 28 is located in the outlet 24.

Figure 2:
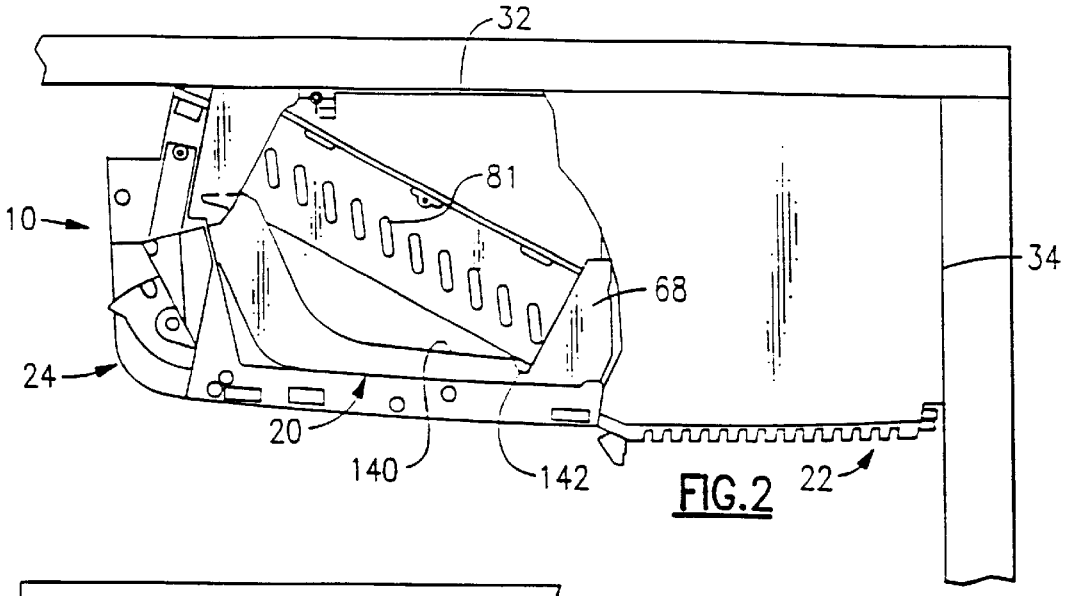
FIG. 2 is a side view of the air conditioning unit of FIG. 1 mounted on a ceiling with a portion of the outer housing broken away.
Figure 3:
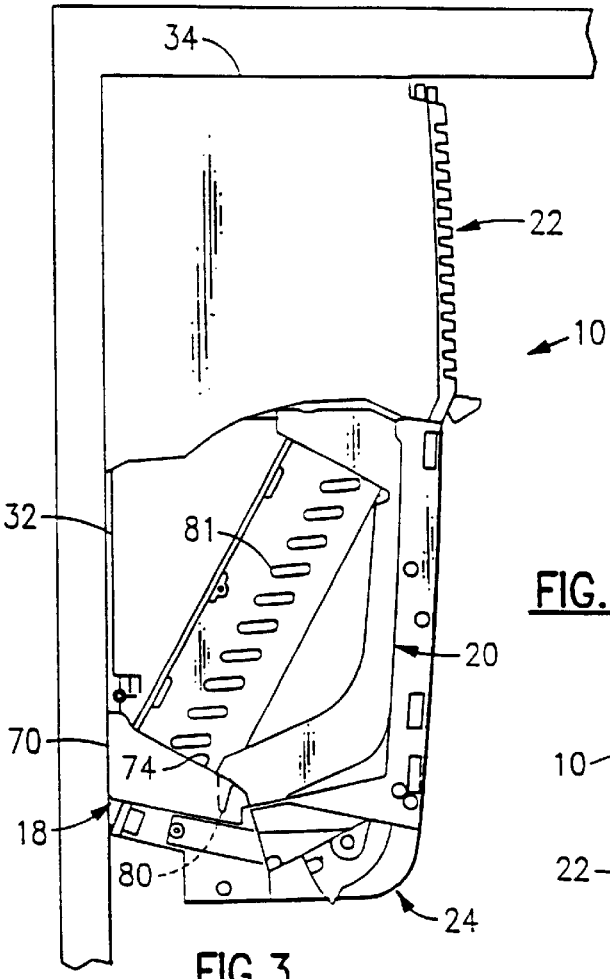
FIG. 3 is a side view of the air conditioning unit of FIG. 1 mounted on a vertical wall adjacent to the ceiling with a portion of the outer housing broken away.
Figure 4:
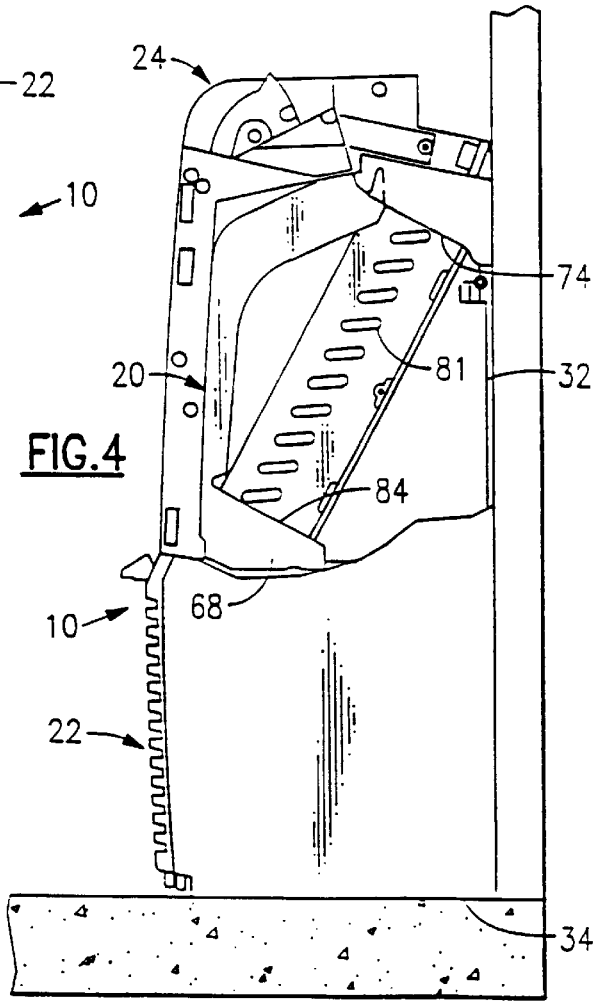
FIG. 4 is a view of the air conditioning unit of FIG. 1 mounted on a floor in a console mount with a portion of the outer housing of the unit broken away.

In operation, a heated or chilled fluid is circulated through the evaporator heat exchanger 16. At the same time the fans 14 draw air into the housing 12 form the space to be conditioned, and force that air over the heat exchanger 16 thereby heating or cooling the air, and forcing the conditioned air through the outlet 24 and back into the space being conditioned. The upper and lower condensate pans 18 and 20 are also supported within the housing 12 adjacent the upper and lower ends respectively of the heat exchanger to collect water that condenses on and drips downward from the heat exchanger during operation of the system. As a result of the configuration of the upper and lower condensate pans 18 and 20, the air conditioner unit 10 may be operated in a console mount position, as illustrated in FIG. 4, a ceiling mount position, as illustrated in FIG. 2 or in a high-wall mount with the air discharge 24 at the lower end thereof, as illustrated in FIG. 3. As a result of the unique configuration of the upper and lower condensate pans, the unit may be operated in any of these orientations while still collecting and disposing of water that condenses on and drips downward from the heat exchanger 16.

Figure 5:
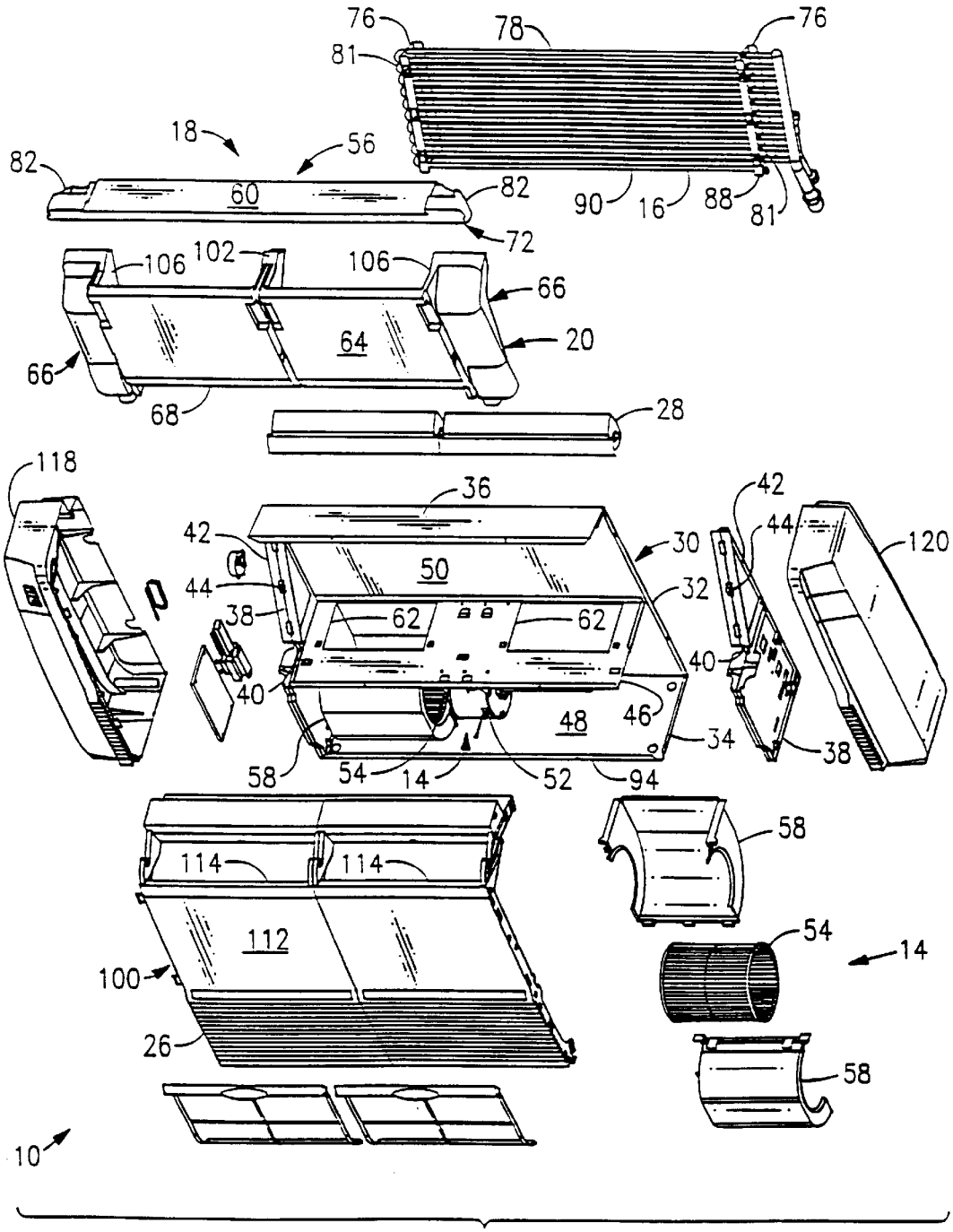
FIG. 5 is an exploded perspective view of the air conditioning unit of FIG. 1.
Figure 6:
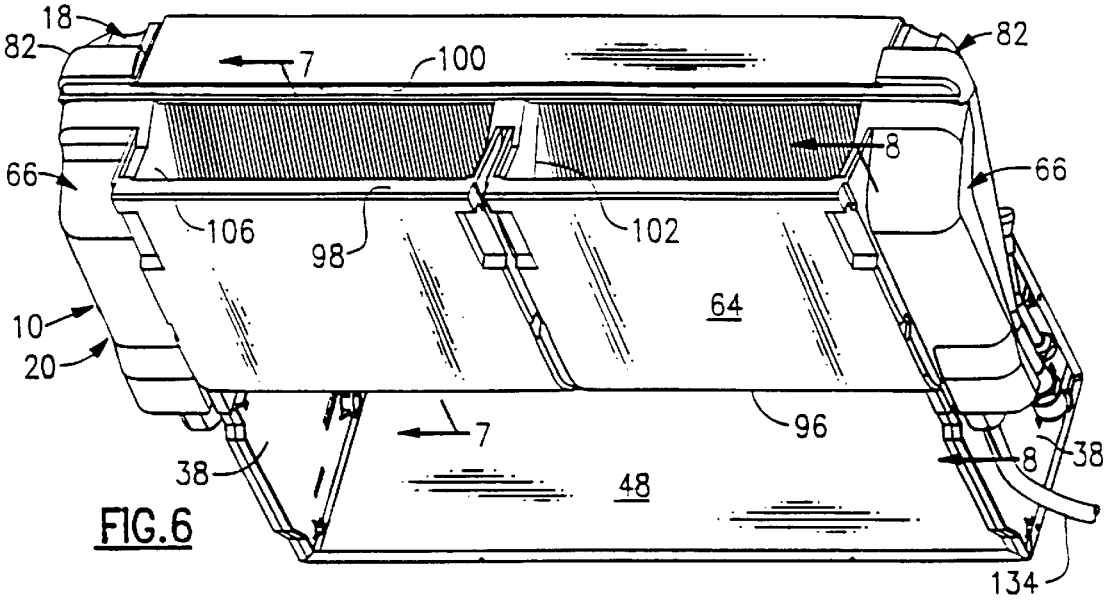
FIG. 6 is a perspective view of the air conditioning unit of FIG. 1 with the outer housing and some of the internal components thereof removed.
Figure 7:
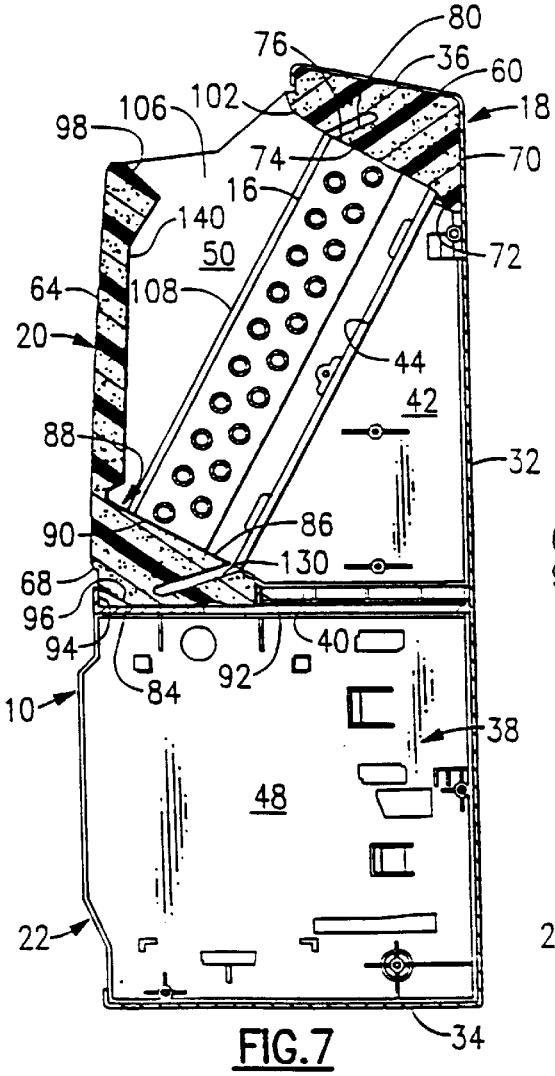
FIG. 7 is a vertical sectional view taken along the line 7—7 of FIG. 6.

Looking now at FIGS. 5, 6 and 7, the housing 12 includes a one-piece structural sheet metal frame 30, which defines the back panel 32, the bottom 34 and an upper flange 36. Structurally attached to opposite ends of the sheet metal structure 30 are internal side panels 38. Each of the side panels 38 is provided with a horizontally extending slot 40, which extends from front to back and a triangular shaped section 42, which extends upwardly from the slots 40 and which each define an angularly positioned heat exchanger mounting surface 44.

A horizontal sheet metal fan mounting panel 46 is adapted to be received in the horizontal slots 40 of the internal side panels 38, as shown in FIG. 5. The fan mounting panel 46 separates the interior of the housing into the lower inlet section 48, which communicates with the previously described inlet 22 via the inlet grill 26 and the outlet section 50 above the fan panel in which the heat exchanger coil 16 is mounted on the inclined surfaces 44 of the internal side panels 38, as best illustrated in FIG. 7.

Referring back to FIG. 5, the evaporator fan 14 comprises an electric motor 52 mounted to the underside of the fan mounting panel 46, which is adapted to drive a pair of centrifugal fans 54 which are in turn enclosed in a two-piece scroll assembly 58, each of which are attached to the lower side of the fan mounting panel 46 and which communicate with rectangular discharge openings 62 in the fan panel.

As best seen in FIGS. 5, 6 and 7, the upper condensate pan 18 comprises a one-piece elongated section fabricated from a foamed plastic material. The pan comprises a central section 56 having a top face 60 adapted to be received and retained under the upper flange 36 of the one-piece sheet metal structural frame 30. The central section 56 also has a back face 70 and a downwardly extending section 72, the back face 70 being adapted to be in confronting relation with the back panel 32 of the sheet metal section 30 and the lower section adapted to be received behind the upper end of the triangular section 42 of the internal side panels 38. As so retained, the upper condensate pan 18 has a substantially planar heat exchanger support surface 74, which is at an angle so as to be in confronting supportive relationship with the top of the heat exchanger 16, as defined by the upper ends of the tube sheets 76 and the heat exchanger fins 78.

Figure 8:
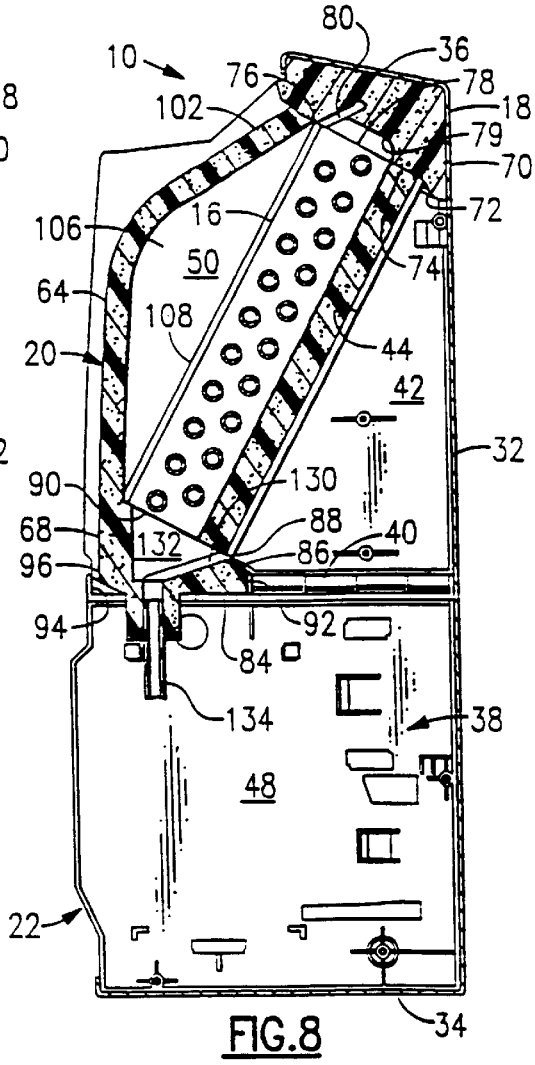
FIG. 8 is a vertical sectional view taken along the line 8—8 of FIG. 6.

As best seen in FIGS. 7 and 8, the upper condensate pan 18 includes a longitudinally extending condensate collection channel 80 passing from the planar section 74 and internally into the collection pan at a rearwardly extending orientation.

The left and right-hand ends of the upper condensate pan 18 include extensions 82 from the central section 56, which are configured to overlie the return bends 81 of the heat exchanger coil extending to the left and right of the tube sheets and forming a condensate collection recess 79 therein, which is in fluid communication with the condensate channel 80.

With reference to FIGS. 5, 6 and 7, the lower condensate pan 20 is a one-piece component fabricated from plastic foam. The pan includes a substantially planar front section 64, left and right lateral extensions 66, and a lower heat exchanger support section 68. The condensate pan 20 is adapted to be installed to the unit following installation of the upper condensate pan 18 and the evaporator heat exchanger 16.

As best seen in FIGS. 7 and 8, the lower heat exchanger support section 68 has a substantially triangular cross-section having a lower surface 84 engaging the upper surface of the front of the fan mounting panel 46 and an inclined longitudinally extending surface 86 adapted to support the lower ends of the heat exchanger tube sheets 88 and the lower ends of the heat exchanger fins 90. A flat longitudinally extending right hand facing surface 92 abuts against a forwardly facing surface of each of the internal side panels 38. Further, an upwardly extending lip 94 is formed on the front side of the fan mounting panel 46, which serves to engage a lower portion 96 of the planar front section 64 of the lower condensate pan to assist in positioning and retaining the pan in the described position.

With reference to FIG. 6, it will be noted that the planar front section 64 of the lower condensate pan is supported in a substantially vertical orientation spaced from the heat exchanger coil with the upper end 98 thereof spaced from the front edge 100 of the upper condensate pan 18. The opening defined by the edges 98 and 100 defines part of the air flow discharge path through the unit. With reference to FIGS. 5–8, the upper condensate pan 20 is supported in the above-described spaced relationship from the heat exchanger coil by a center spacer 102 extending from the top edge 98 of the condensate pan and adapted to engage the front of the heat exchanger coil at the top thereof underling the front edge 100 of the upper condensate pan. As best shown in FIGS. 6, 7 and 8, additional support spacing of the lower condensate pan 20 is provided by lateral walls 106 on the left and right-hand sides of the planar front section 64, which are adapted to engage the front surface 108 of the heat exchanger tube sheets to thereby not only position the lower condensate pan, but provide an air tight seal therebetween to further define the above-described air flow path.

As best seen in FIGS. 1 and 5, an outer cover 100, which includes the inlet grill 26, a solid section 112 and an elongated opening 114 in which the discharge louvers 28 are mounted, is adapted to be structurally attached to and cover the front and the top of indoor unit 10. External side covers 18 and 120 are adapted to be attached to the left and right sides of the unit to complete the outer housing, as illustrated in FIG. 1.

The indoor evaporator unit 10, as described above, is capable of being installed in the three different orientations illustrated in FIGS. 2, 3 and 4. In FIG. 4, a console installation is shown wherein the unit is mounted with the bottom 34 on a floor and the back panel 32 against an interior wall. The inlet/inlet grill 22/26 are located at the bottom of the unit and the air discharge/discharge louver 24/28 is located at the upper side to thereby direct the air from the upper end into the room. As illustrated in FIG. 6, the fins of the heat exchanger 16 extend vertically with the heat exchanger tubes extending transversely. With this configuration, any condensate removed from the air passing through the heat exchanger will fall under the influence of gravity downwardly following the fins and/or tube sheets to the angularly disposed heat exchanger mounting surface 86 of the lower condensate pan 20.

It will be noted, as shown in FIGS. 7 and 8, that an elongated condensate collection slot 130 extends the length of the lower heat exchanger support section 68. The collection slot 130 communicates at its right and left-hand ends with a plenum 132. as shown in FIG. 8. Either the left or right-hand plenum may be interconnected with a suitable drain tube 134 such as shown in FIGS. 6 and 8, which is adapted to conduct collected condensate to an appropriate disposal location.

Looking, now at FIG. 2, the unit 10 is shown with the back panel 32 in a horizontal position attached to the ceiling of a room to be conditioned and with the bottom 34 adjacent an interior wall. As such, the inlet/inlet grill 22/26 faces downwardly and the outlet/discharge louvers 24/28 is also directed downwardly into the space to be conditioned. When oriented in this manner, condensate forming on the heat exchanger 16 will fall downwardly under the influence of gravity and be collected by the inside 140 of the planar front section 64 of the lower condensate pan 20. The collected condensate will migrate to a low point 142 which communicates with the plenum 132, as illustrated in FIG. 8. The plenum 132 is then appropriately interconnected with a drain tube passing through an opening in the bottom of the side section 66 of the condensate pan 20. The drain arrangement is similar to that shown in FIG. 8 and will not be shown in detail.

FIG. 3 illustrates the unit 10 mounted in a high-wall installation wherein the back panel 32 is adjacent to an indoor wall and the "bottom" 34 is in contact with the ceiling of the room to be conditioned. As so installed, the air inlet/inlet grill 22/26 is located at the top of the unit adjacent the ceiling while the air outlet/discharge louver 24/28 is located at the lower end of the unit and discharges outwardly and downwardly into the space to be conditioned. When installed in this manner. water which condenses on the heat exchanger 16 will flow downwardly and to the left following the fins and/or tube sheets of the heat exchanger to the inclined support surface 74 of the upper condensate pan 18.

As best shown in FIGS. 7 and 8, the upper condensate collection channel 80 is aligned with the lower right-hand corner of the heat exchanger, as viewed in FIG. 3. The condensate collection channel 80 is adapted to receive condensate from the heat exchanger and is in fluid communication at the left and right-hand ends thereof with the collection recess 79, as illustrated in FIG. 8. Further, as shown in FIG. 8, an appropriate drain tube (not shown) may be installed in fluid communication with the collection recess 79 at either the left or right sides of the upper condensate pan 18 to thereby direct the collected condensate to an appropriate disposal location.

What is claimed is:

1. An evaporator unit for an air conditioning system, the evaporator unit being of the type which includes:

a housing having a back panel and a front section, the front section defining an air inlet proximate one end thereof and an air outlet proximate an opposite end thereof, the housing further defining an air flow path therethrough extending from said inlet to said outlet;

an evaporator coil supported in said housing in said air flow path; and an evaporator fan for effecting air flow along said air flow path and through said evaporator coil, whereby water is removed from said air flowing through said evaporator coil as a result of condensation upon the cold surface of the coil. wherein the improvement comprises:

a first condensate collection pan mounted in said housing proximate to said evaporator coil, said first condensate collection pan being configured to collect condensate from said evaporator coil when said evaporator unit is mounted with said back panel in a substantially vertical orientation with said one end defining the lower end of said housing, and said opposite end defining the upper end of said housing, said first condensate collection pan further being configured to collect condensate from said evaporator coil when said evaporator unit is mounted with said back panel facing upwardly in a substantially horizontal orientation; and a second condensate collection pan mounted in said housing proximate to said evaporator coil, said second condensate collection pan being configured to collect condensate from said evaporator coil when said evaporator unit is mounted with said back panel in a substantially vertical orientation with said one end defining the upper end of said housing, and said opposite defining the lower end of said housing.

2. The apparatus of claim 1 wherein with reference to said back panel in a substantially vertical orientation, with said one end defining the lower end of said housing and said opposite end defining the upper end of said housing, said evaporator coil is oriented in an inclined position with an upper end thereof proximate said back panel and said opposite end, and the lower end of said coil is proximate said front section of said housing;

wherein said second condensate collection pan overlies and is coextensive with said upper end of said evaporator coil; and wherein said first condensate collection pan underlies and is coextensive with said lower end of said evaporator coil.

3. The apparatus of claim 2 wherein said first condensate collection pan further extends substantially vertically upwardly parallel to said front section a distance such that the upper end of said second condensate collection pan is spaced from said second condensate collection pan to together define a portion of said air flow path.

4. The apparatus of claim 2 wherein said evaporator coil comprises right and left-hand tube sheets, having a plurality of horizontally disposed tubes extending therebetween defining a refrigerant flow circuit therethrough, said evaporator coil further comprising a plurality of heat exchange fins mounted on said plurality of tubes and substantially perpendicular thereto, whereby the flow of water condensing on said tubes and said fins will be in the direction of said fins.

5. The apparatus of claim 4 wherein each of said first condensate collection pan and said second condensate collection pan extends at the left and right-hand ends thereof beyond the left and right-hand tube sheets of said evaporator coil.

6. The apparatus of claim 5 wherein at least one of said tube sheets includes refrigerant inlet and outlet means communicating with said horizontally disposed tubes and wherein each of said first and second condensate pans extend laterally outwardly of said inlet and outlet means.

7. The apparatus of claim 6 wherein said first condensate collection pan comprises a horizontally extending condensate collection slot disposed adjacent the lower most end of said evaporator coil; and wherein said second condensate collection pan comprises a condensate collection slot therein adjacent the upper most section of said evaporator coil.

8. The apparatus of claim 7 wherein said first condensate collection pan further includes means therein in fluid communication with said slot adapted to be accessible by condensate drain means; and wherein said second condensate collection pan includes means therein in fluid communication with said slot adapted to be accessible by condensate drain means.

9. The apparatus of claim 8 wherein both of said condensate collection pans are fabricated from a molded foam material.

* * * * *